US006644437B1

(12) United States Patent
Hayman

(10) Patent No.: US 6,644,437 B1
(45) Date of Patent: Nov. 11, 2003

(54) VEHICLE EXHAUST WITH LENGTH-EQUALIZING MUFFLER

(75) Inventor: Alan William Hayman, Romeo, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/211,604

(22) Filed: Aug. 2, 2002

(51) Int. Cl.[7] ..... F01N 1/00; F01N 1/08

(52) U.S. Cl. ..... 181/268; 181/237; 181/272

(58) Field of Search ..... 181/268, 254, 181/212, 216, 227, 228, 236, 237, 253, 238, 272

(56) References Cited

U.S. PATENT DOCUMENTS

| | | | | | |
|---|---|---|---|---|---|
| 3,388,769 | A | * | 6/1968 | Martoia | 181/238 |
| 4,645,031 | A | * | 2/1987 | Omura et al. | 181/232 |
| 5,144,800 | A | * | 9/1992 | Shioya et al. | 60/323 |
| 5,195,607 | A | * | 3/1993 | Shimada et al. | 180/296 |
| 5,351,483 | A | * | 10/1994 | Riley et al. | 60/274 |
| 5,519,994 | A | * | 5/1996 | Hill | 60/313 |
| 5,723,827 | A | * | 3/1998 | Sasaki et al. | 181/237 |
| 5,773,770 | A | * | 6/1998 | Jones | 181/268 |
| 5,775,100 | A | * | 7/1998 | Sloss et al. | 60/299 |
| 6,176,347 | B1 | * | 1/2001 | Chae et al. | 181/254 |
| 6,189,650 | B1 | * | 2/2001 | Inuzuka et al. | 181/254 |

FOREIGN PATENT DOCUMENTS

EP 0 421724 A1 * 10/1990 ..... F01N/1/0624

* cited by examiner

*Primary Examiner*—Robert E. Nappi
*Assistant Examiner*—Eduardo Colon-Santana
(74) *Attorney, Agent, or Firm*—Leslie C. Hodges

(57) ABSTRACT

An exhaust system provides the benefits of equal or near equal length exhaust pipes for vehicles (for example with transverse engines) having differing length exhaust pipes connected with a single muffler. In accordance with the invention, the muffler has separate first and second internal inlet pipes which have lengths differing by a predetermined length dimension equal or nearly equal to the difference in exhaust pipe lengths. The inlet pipes are connected so that the total lengths of the pairs of inlet pipes and connected exhaust pipes provide a total length of exhaust flow path which is generally equal for gas flow from both engine banks to the interior of the muffler. An optional feature is dual restricted and valve-controlled outlet flow paths which maintain a minimum back pressure at low flows to aid EGR distribution and allow high flow rates at low back pressure for high performance output of the engine with a performance sound.

12 Claims, 3 Drawing Sheets

VEHICLE EXHAUST WITH LENGTH-EQUALIZING MUFFLER

TECHNICAL FIELD

This invention relates to vehicle exhaust systems, in particular to systems having unequal length exhaust pipes and to a muffler including unequal length internal inlet pipes for equalizing the length of connected pairs of pipes delivering exhaust gas flow to the muffler interior.

BACKGROUND OF THE INVENTION

In automotive vehicles with longitudinally-mounted engines having exhaust systems with dual exhaust pipes leading to a single muffler, the dual exhaust pipes may have essentially equal lengths. Such systems tend to deliver to the muffler exhaust gas having similar sound wave and gas flow patterns, which generally results in a pleasant sound quality of the engine exhaust note.

On the other hand, transverse-mounted engines may have exhaust systems with dual exhaust pipes leading from opposite front and rear cylinder banks of the engine to a single muffler. In such systems the exhaust pipes may have a difference in length that is in excess of one meter. This difference yields sound wave additions and cancellations, causing the quality of the exhaust note to be substantially inferior to those systems that have nearly equal length geometries. The result is typically a "raspy" quality to the exhaust note.

A further characteristic of high flow low back pressure exhaust systems is that, when the exhaust flow rates are low, the back pressure is reduced and the systems are subject to pulsations which interfere with equal internal distribution of recirculated exhaust gas (EGR) to the cylinders.

Accordingly, a system is desired which improves the sound quality of exhaust systems for vehicles with transversely-mounted engines and other systems with differing dual exhaust pipe lengths. Preferably, the system could also improve EGR distribution at low exhaust flow rates without causing excessive exhaust back pressure at high exhaust flow rates.

SUMMARY OF THE INVENTION

The present invention provides an active muffler and vehicle exhaust system, particularly for transverse engines but applicable to other vehicle engines. The system provides the benefits of equal or nearly length exhaust pipe systems of longitudinally-mounted engines to exhaust systems where unequal length exhaust pipes are utilized.

In accordance with the invention, a single exhaust muffler is provided with separate first and second internal inlet pipes which have lengths differing by a predetermined length dimension. The difference in lengths is made equal, or nearly equal, to the difference in the lengths of exhaust pipes extending from the associated engine exhaust outlets to the single exhaust muffler. The inlet pipes are connected so that the total lengths of the pairs of inlet pipes with their corresponding connected exhaust pipes provide total lengths of exhaust flow paths which are approximately equal for gas flow from both engine banks to the interior of the muffler.

An optional additional feature of the muffler is the provision of dual outlet flow paths for the exhaust gas. These include a restricted gas flow path which is always open and a low restriction flow path controlled by a back pressure valve which closes the passage at low exhaust gas flow rates.

The exhaust gas back pressure is thus raised at low flows so that EGR distribution to the cylinders is improved. The valve is opened at higher exhaust flow rates so that back pressure in the muffler is reduced, allowing the passage of exhaust gas through a high flow low back pressure system. This provides for high performance output of the engine, undiminished by excessive back pressure in the manifold. The dual outlet paths may also provide a performance sound to the high flow exhaust note.

These and other features and advantages of the invention will be more fully understood from the following description of certain specific embodiments of the invention taken together with the accompanying drawings.

DESCRIPTION OF THE PREFERRED EMBODIMENT

Figure 1:
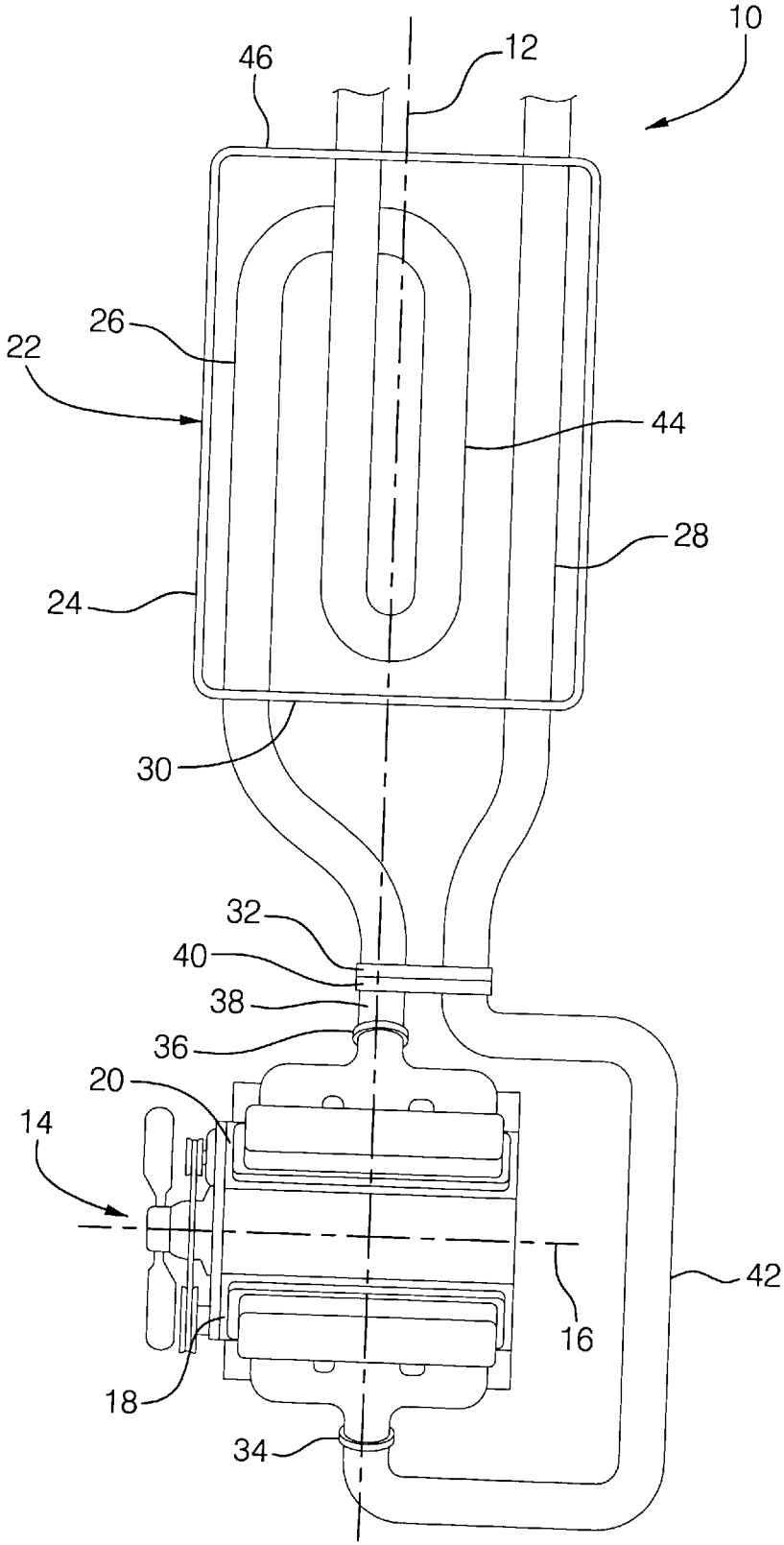
FIG. 1 is a schematic view illustrating the arrangement of an exhaust system for a transverse-mounted vehicle engine connected with a muffler having equalizing inlet pipes according to the invention.

Referring first to FIG. 1 of the drawings in detail, numeral 10 generally indicates an automotive vehicle, such as an automobile, having a longitudinal axis 12. An engine 14 is mounted in a forward portion of the vehicle and disposed transversely, with the axis 16 of the engine crankshaft, not shown, lying normal to the longitudinal vehicle axis 12. The engine is of the V-type, having left and right cylinder banks 18, 20, respectively. The engine is mounted conventionally with its front end facing the right side of the vehicle so that the left cylinder bank 18 lies toward the front of the vehicle while the right cylinder bank 20 lies toward the rear of the vehicle.

The vehicle 10 is provided with an exhaust muffler 22 having an outer shell 24 enclosing first and second internal inlet pipes 26, 28, respectively. The inlet pipes extend through a front wall 30 of the muffler to connection with a mounting flange 32.

The left and right engine cylinder banks 18, 20 include exhaust outlets 34, 36, respectively, displaced toward the front and rear of the vehicle. A first exhaust pipe 38 connects the rear exhaust outlet 36 with the first inlet pipe 26 of the muffler through a mounting flange 40 connected with the manifold mounting flange 32. A second exhaust pipe 42 connects the front exhaust outlet 34 with the second inlet pipe 28, also through the mounting flanges 40, 32.

Because of the relatively close spacing between the rear engine exhaust outlet 36 and the mounting flange 40, the first exhaust pipe 38 is relatively short. On the other hand, the second exhaust pipe 42, connecting the forward exhaust outlet 34 with flange 40, is substantially longer, by a predetermined length dimension, than the first exhaust pipe 38. The difference in pipe lengths is due not only to their being mounted on opposite rear and forward sides of the engine but also to the necessary routing of the second exhaust pipe 42 around the engine to the flange 40 mounted behind the engine.

In accordance with the invention, the total length of the short first exhaust pipe 38 and its connected second inlet pipe 26 within the muffler is made approximately equal to the length of the longer second exhaust pipe 42 and the connected second inlet pipe 28 within the muffler. This is accomplished by extending the length of the first inlet pipe 26 within the muffler by the differential dimension so that the total length of the pair of pipes 38, 26 is approximately equalized with the total length of the pair of pipes 42, 28. This length extension is accomplished, as shown schematically in FIG. 1, by a return loop 44 in the first inlet pipe 26 so that the length of pipe 26 within the muffler is longer than that of the second inlet pipe 28 by the predetermined length dimension.

While approximately equal exhaust pair lengths are generally preferred at present, some systems may have acceptable, or even preferable, sound or may better meet packaging requirements, with substantial length variations between the two pairs of connected pipes. Such variations could be as small as 6 inches or 15 mm or as great as 15 percent of the total length of the longer of the pipe pairs within the scope of the broader aspects of the invention.

The schematic illustration of FIG. 1 shows in simple form the looped internal form of the longer inlet pipe 26 which makes up for the shorter length of the connected exhaust pipe 38 to provide essentially equal length pairs of connected exhaust and inlet pipe assemblies. However, the illustration of the muffler 22 in FIG. 1 does not show the tuning and quieting components of the muffler, but shows the inlet pipes 26, 28 as extending completely through the muffler and out a rear wall 46 without any obvious connection with resonance chambers within the muffler. Thus, FIG. 1 is illustrative of the manner in which the connecting pipes of the exhaust system are substantially equalized in length but does not indicate other features of the muffler construction.

Figure 2:
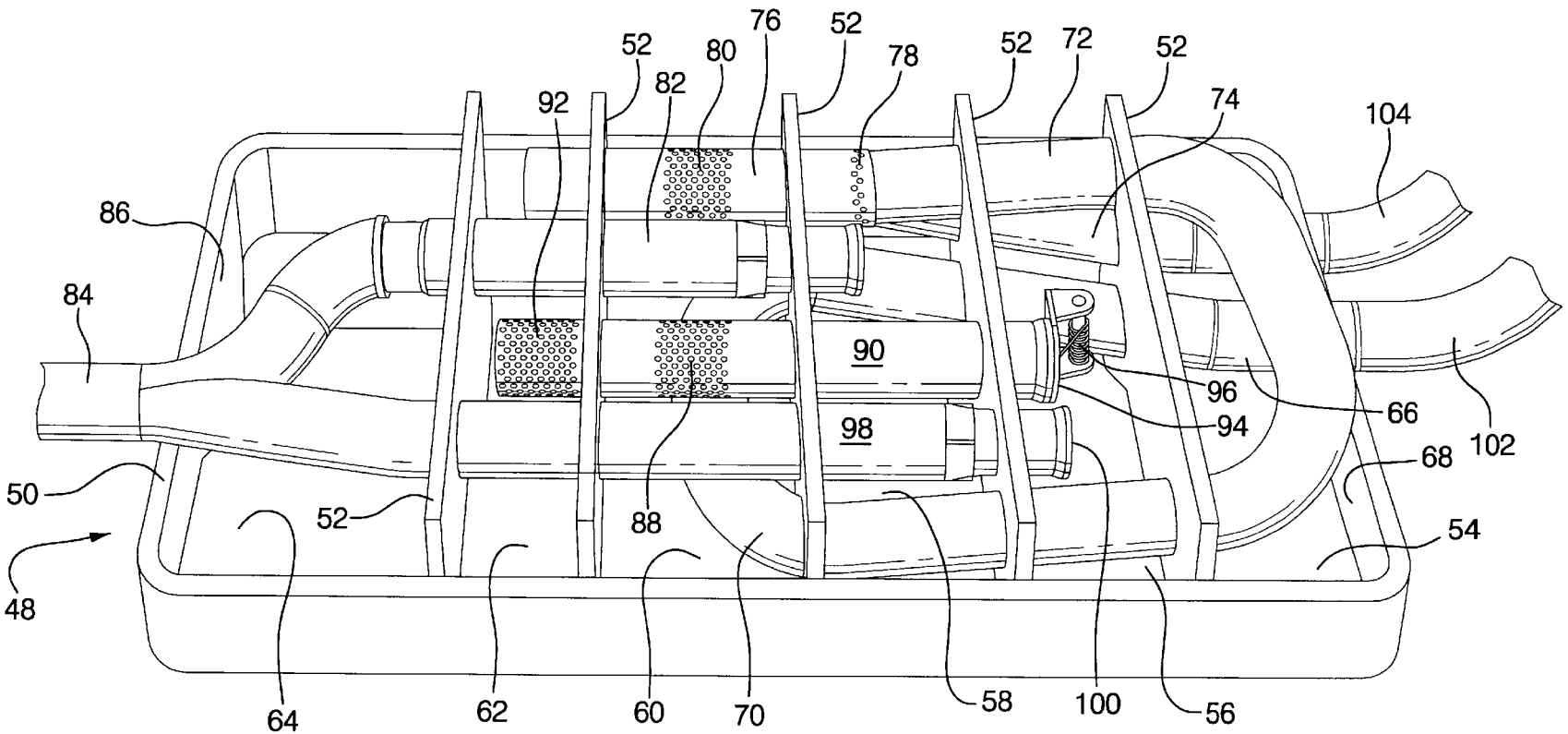
FIG. 2 is a pictorial view illustrating an exemplary arrangement of internal pipes and chambers for a muffler according to the invention.
Figure 3:
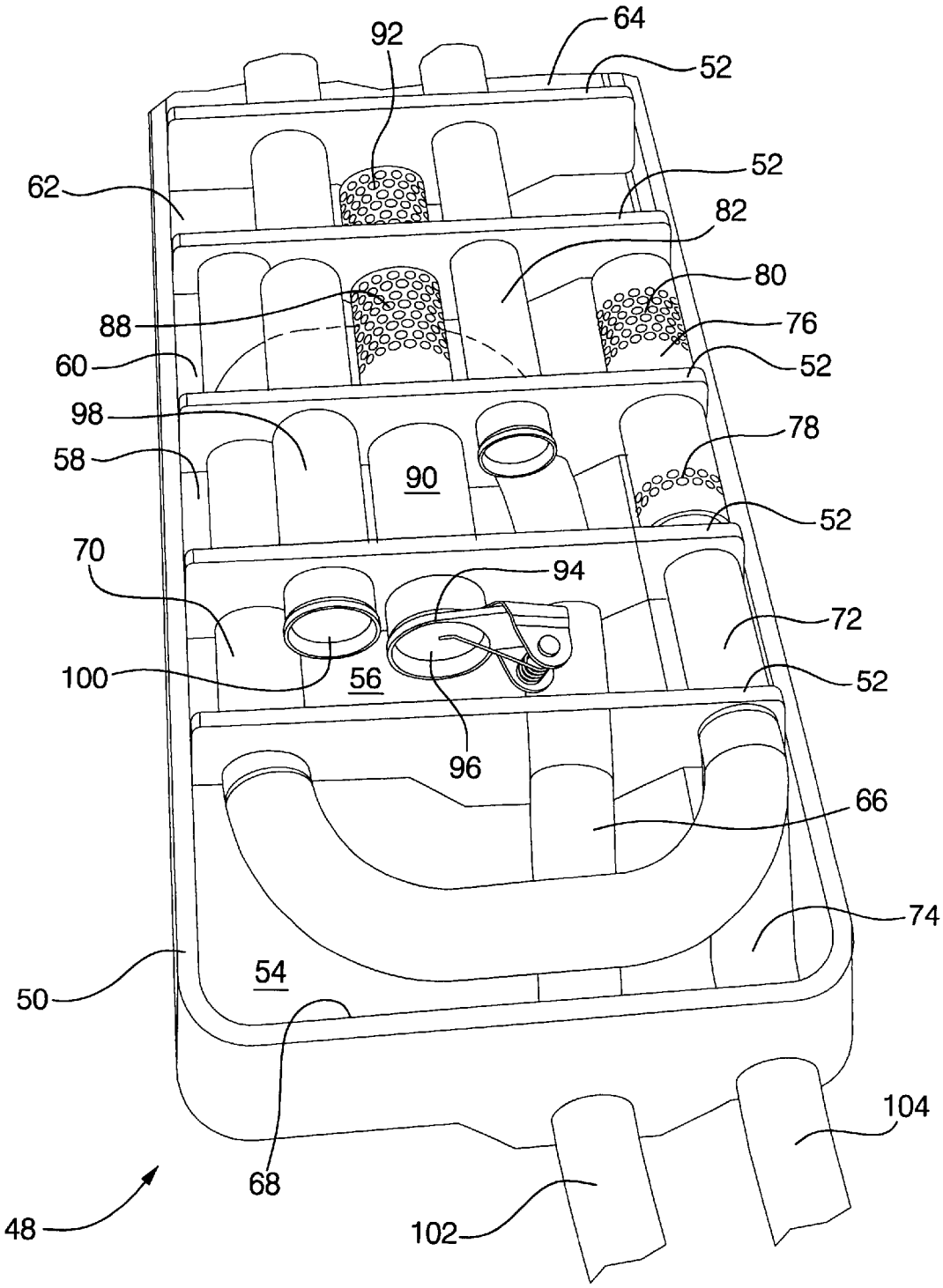
FIG. 3 is a pictorial view from the inlet end showing the back pressure valve mounting within the manifold of FIG. 2.

Referring to FIGS. 2 and 3, pictorial views of an actual muffler 48 embodying various features of the invention are shown. Muffler 48 includes an outer shell 50 shown with its upper portion removed to display the interior of the muffler. The interior volume is divided by a plurality of bulkheads 52 into a series of chambers including an inlet chamber 54, a transfer chamber 56, a low flow chamber 58, a high flow and resonance chamber 60, a resonance chamber 62 and an outlet chamber 64.

A first inlet pipe 66 enters the manifold interior through a front wall 68 and is formed with a return loop 70 that passes through several of the chambers, returning to the inlet chamber 54. Here, the loop 70 again turns rearward and is joined by a connector 72 with a relatively short second inlet pipe 74. The passages of the two inlet pipes are thus joined together and connected with a distribution pipe 76.

Pipe 76 includes two serially-spaced outlets including a restricted, low flow outlet 78 and a low restriction, high flow outlet 80. The low flow outlet 78 comprises a ring of a limited number of perforations in the distribution pipe wall, forming a restricted flow path for exhaust gas from the distribution pipe 76 to the low flow chamber 58. The high flow outlet 80 comprises a substantially greater number of small perforations through the wall of the distribution pipe 76 connecting the pipe interior with the high flow chamber 60.

The low flow chamber 58 communicates with the end of a first connector pipe 82, which extends toward the rear of the muffler and connects with a single outlet pipe 84 extending through the rear wall 86 of the muffler. The high flow outlet 80 connects through the high flow chamber 60 with a high flow inlet 88 in a longitudinal transfer pipe 90. This transfer pipe also has a perforated resonance outlet 92 to the resonance chamber 62 and has an open opposite end 94 communicating with the transfer chamber 56. A door valve 96 closes the open end 94 of the transfer pipe and is openable by exhaust pressure and temperature, or by suitable control means, to permit high gas flow from the open end 94 of the pipe 90. A second connector pipe 98 also includes an open end 100 which opens into the transfer chamber 56. Pipe 98 extends rearward from the transfer chamber to a connection with the first connector pipe 82 in the outlet chamber 64 where the two pipes join the single outlet pipe 84 extending through the rear wall 86 of the manifold.

In operation, exhaust gas flows from the rear exhaust outlet, not shown, of the engine, through a short first exhaust pipe 102 to the first inlet pipe 66, where it travels around the return loop 70 until it joins the short second inlet pipe 74 at the connector 72. Concurrently, exhaust flow from the front exhaust outlet, not shown, of the engine passes through the long exhaust pipe 104 and the second inlet pipe 74 into connector 72, where it joins exhaust flow from the first inlet pipe 66.

Exhaust gas from the connector 72 passes through the restricted low flow outlet 78 of the distribution pipe 76 into the low flow chamber 58. It then enters into the open end of the first connector pipe 82 and is carried to the rear of the muffler and into the single outlet pipe 84.

At low exhaust gas flows, as occurs during low speed and low load engine operation, the control door valve 96 remains closed, blocking the outlet 94 of the transfer pipe 90. In this condition, the high flow chamber 60 acts as a resonance chamber which absorbs pulsations in the gas flow within the volume of the chamber 60 as well as through the transfer of gas from the high flow outlet 80 to the high flow inlet 88 of the transfer pipe 90. Some of this gas passes through the resonance outlet 92 into the resonance chamber 62 so that chambers 62 and 60 both contribute to muffling of the sound generated by the exhaust gas flow during low speed and load, low gas flow operation of the engine.

When the engine speed and load increase, so that back pressure in the exhaust system reaches a predetermined higher value, the control valve 96 is opened, either through a valve actuator, not shown, or by the action of the back pressure, assisted by gas temperature which reduces the closing force of the valve return spring. Then a substantially increased free flow of exhaust gas passes through the open end 94 of the transfer valve into the transfer chamber 56 and into the open end 100 of the second connector pipe 98. Pipe 98 carries the exhaust gas to the single outlet pipe 84 where it is mixed with gas from the first inlet pipe 66 for exhaust from the vehicle. When the valve 96 is opened, the resistance to flow in the muffler is substantially reduced, so that a larger flow of exhaust gas through the muffler is permitted without a large increase in exhaust. back pressure. Thus, maximum performance of the engine at higher speeds and loads is assured.

Operation of the control valve 96 is designed to maintain a minimum exhaust back pressure in the inlet pipes 66, 74 of the muffler during low gas flow at low speed and load engine conditions. The back pressure increases internal recirculation of exhaust gas (EGR) to the engine cylinders so that equal distribution of the recirculated exhaust gas to the cylinders may be maintained. At higher speeds and loads, opening of the control valve 96 maintains a controlled back pressure within the muffler so that exhaust gas recirculation remains at a controllable level while high performance of the engine with high gas flow and low back pressure within the muffler is maintained.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A vehicle engine exhaust system comprising:

a single exhaust muffler having adjacent first and second internal inlet pipes and a single outlet pipe;

a pair of first and second exhaust pipes connecting spaced engine exhaust outlets with the first and second inlet pipes, respectively, of the single muffler, the first exhaust pipe being shorter than the second exhaust pipe by a predetermined length dimension;

said first internal inlet pipe of the muffler being longer than the second internal inlet pipe by approximately said predetermined length dimension, whereby the total lengths of the first and second exhaust pipes and their connected first and second internal inlet pipes are nearly equal for delivering exhaust gas flow with similar sound wave and exhaust flow patterns to the interior of the muffler;

wherein said first and second internal inlet pipes connect with both low and high flow chambers of the muffler which are separately connected to respectively deliver low and high flow volumes of exhaust gas from both inlet pipes to the single outlet pipe.

2. A vehicle engine exhaust system as in claim 1 wherein said internal inlet pipes are connected to a common distributor pipe which connects with the low and high flow chambers.

3. A vehicle engine exhaust system as in claim 1 wherein exhaust flow from the high flow chamber is controlled by a valve, closed at lower exhaust flows and opened for higher exhaust flows through the muffler.

4. A vehicle engine exhaust system comprising:

a single exhaust muffler having adjacent first and second internal inlet pipes and a single outlet pipe;

a pair of first and second exhaust pipes connecting longitudinally spaced engine exhaust outlets with the first and second inlet pipes, respectively, of the single muffler, the first exhaust pipe being shorter than the second exhaust pipe by a predetermined length dimension;

said first internal inlet pipe of the muffler being longer than the second internal inlet pipe by a compensating dimension differing from said predetermined length dimension by a value not greater than 15 percent of the total lengths of the first and second exhaust pipes and their connected first and second internal inlet pipes for delivering exhaust gas flow with generally similar sound wave and exhaust flow patterns to the interior of the muffler.

5. A muffler adapted for reducing unbalance of pipe lengths in a vehicle engine exhaust system, the muffler comprising:

an outer shell enclosing first and second internal inlet pipes and a single outlet pipe; the first internal inlet pipe being longer than the second internal inlet pipe by a predetermined length dimension;

the first and second internal pipes adapted for connection, respectively, with external first and second exhaust pipes of differing lengths adapted to connect with spaced exhaust outlets of an engine, the second exhaust pipe being longer than the first exhaust pipe by approximately said predetermined length dimension;

whereby, the internal inlet pipes, when connected with their respective external exhaust pipes form pairs of connected pipes of approximately equal length for delivering engine exhaust gas flow with similar sound wave and exhaust flow patterns to the interior of the muffler;

wherein said first and second internal inlet pipes connect with both low and high flow chambers of the muffler which are separately connected to respectively deliver low and high flow volumes of exhaust gas from both inlet pipes to the single outlet pipe.

6. A muffler as in claim 5 wherein said internal inlet pipes are connected to a common distributor pipe which connects with the low and high flow chambers.

7. A muffler as in claim 6 wherein the connection of the distributor pipe with the low flow chamber has a smaller flow area than does the connection of the distributor pipe with the high flow chamber.

8. A muffler as in claim 6 including a first connector pipe connecting the low flow chamber with the single outlet pipe.

9. A muffler as in claim 6 including a second connector passage between the high flow chamber and the single outlet pipe, and a valve operative to close the second connector passage in a lower range of exhaust flow through the manifold and to open the passage to flow above said lower range.

10. A muffler as in claim 9 wherein the second connector passage includes a transfer pipe between the high flow chamber and a transfer chamber and a second connector pipe between the transfer chamber and the single outlet pipe, the valve being disposed in the transfer chamber.

11. A muffler as in claim 10 wherein the valve is disposed on an end of the transfer pipe in the transfer chamber.

12. A muffler adapted for reducing unbalance of pipe lengths in a vehicle engine exhaust system, the muffler comprising:

an outer shell enclosing first and second internal inlet pipes and a single outlet pipe; the first internal inlet pipe being longer than the second internal inlet pipe by a predetermined length dimension;

the first and second internal pipes adapted for connection, respectively, with external first and second exhaust pipes of differing lengths adapted to connect with spaced exhaust outlets of an engine, the second exhaust pipe being longer than the first exhaust pipe by approximately said predetermined length dimension;

whereby, the internal inlet pipes, when connected with their respective external exhaust pipes form pairs of connected pipes of approximately equal length for delivering engine exhaust gas flow with similar sound wave and exhaust flow patterns to the interior of the muffler;

wherein said first internal inlet pipe includes a return loop extending from an entry portion to an exit portion that joins with the second internal inlet pipe for connection with an interior portion of the muffler, the return loop having wide bends with small curvatures, avoiding sharp corners to promote the free flow of exhaust gas in the first internal inlet pipe.

* * * * *